US011435172B2

(12) United States Patent
Mansell

(10) Patent No.: US 11,435,172 B2
(45) Date of Patent: Sep. 6, 2022

(54) MODULAR AMMUNITION ORGANIZATION SYSTEM

(71) Applicant: Ryan Mansell, Temecula, CA (US)

(72) Inventor: Ryan Mansell, Temecula, CA (US)

( * ) Notice: Subject to any disclaimer, the term of this patent is extended or adjusted under 35 U.S.C. 154(b) by 0 days.

(21) Appl. No.: 17/366,699

(22) Filed: Jul. 2, 2021

(65) Prior Publication Data

US 2022/0090896 A1 Mar. 24, 2022

Related U.S. Application Data

(60) Provisional application No. 63/080,996, filed on Sep. 21, 2020.

(51) Int. Cl.

| | |
|---|---|
| ***F42B 39/26*** | (2006.01) |
| ***F42B 39/22*** | (2006.01) |
| ***B65D 21/02*** | (2006.01) |

(52) U.S. Cl.

CPC ..... *F42B 39/26* (2013.01); *B65D 21/0201* (2013.01); *F42B 39/22* (2013.01)

(58) Field of Classification Search

CPC ..... F42B 39/26; F42B 39/22; F42B 39/00; F42B 39/28; F42B 39/02; F42B 39/002; F42B 39/08; B65D 21/0201; B65D 21/0204; F41A 23/18; F41C 33/0245

USPC ..... 206/504, 3, 931, 349

See application file for complete search history.

(56) References Cited

U.S. PATENT DOCUMENTS

| | | | | |
|---|---|---|---|---|
| 3,341,053 | A * | 9/1967 | Keene | B65D 1/243 206/427 |
| 5,052,549 | A * | 10/1991 | Scharch | F42B 39/00 206/3 |
| 2009/0090647 | A1* | 4/2009 | Panchai | B65D 21/0231 206/509 |
| 2010/0089850 | A1* | 4/2010 | Hovatter | B01L 9/523 211/85.18 |
| 2011/0198256 | A1* | 8/2011 | Rebstock | H01L 21/67326 206/504 |
| 2015/0096907 | A1* | 4/2015 | Connolly | F42B 39/26 206/3 |
| 2015/0342319 | A1* | 12/2015 | Lee | B26B 21/24 206/354 |

(Continued)

*Primary Examiner* — Rafael A Ortiz
*Assistant Examiner* — Sanjidul Islam
(74) *Attorney, Agent, or Firm* — Cionca IP Law P.C.; Marin Cionca

(57) ABSTRACT

An ammunition organization system having a plurality of ammunition organization rows connected to each other through magnetic row couples to form an ammo stack, and a cover attached to the ammo stack row couples by magnetic cover couples. The ammunition organization system allows for ammunition to be stored neatly, while reducing the difficulty of extracting ammunition by allowing the rows to be selectively separated from or combined to each other. Each ammunition organization row has a known quantity of ammunition slots for holding ammunition, making it easy to determine the amount of ammunition held within. The ammunition slots also allow for easy identification of each round, allowing multiple types of ammo to be organized concisely within the same ammunition organization system. Alternative coupling methods including pins, clasps, or other coupling systems may also be used in connecting the ammunition organization rows to each other as well as the cover.

11 Claims, 9 Drawing Sheets

(56) References Cited

U.S. PATENT DOCUMENTS

| | | | | |
|---|---|---|---|---|
| 2016/0116263 | A1* | 4/2016 | Engmann | A45C 13/36 206/3 |
| 2016/0167841 | A1* | 6/2016 | Blagojevic | F42B 39/26 206/3 |
| 2020/0109930 | A1* | 4/2020 | Lutz | F42B 39/26 |
| 2020/0198828 | A1* | 6/2020 | Berkbigler | A45D 40/24 |

* cited by examiner

MODULAR AMMUNITION ORGANIZATION SYSTEM

CROSS-REFERENCE TO RELATED APPLICATIONS

This application claims the benefit of U.S. Provisional Application No. 63/080,996, filed Sep. 20, 2020, which is hereby incorporated by reference, to the extent that it is not conflicting with the present application.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to organization and storage systems for ammunition and specifically to modular ammunition organization systems.

2. Description of the Related Art

Current technologies used for the storage of bulk ammunition (rounds) result in a variety of issues that may slow or otherwise encumber round extraction, as well as create disorganization. Ammo cans and cases can simply pile rounds on each other in an asynchronous manner, making it disorganized and difficult to determine how many rounds are held within. Ammo trays provided in ammo boxes attempt to alleviate the disorder associated with these bulk ammo storage methods by providing a housing in which the rounds are stored in many rows and columns, allowing for a large amount of ammo to be stored, while keeping the rounds in the same orientation. Some ammo trays provide rounds in tightly packed rows and columns, in order to provide a high-density storage method. A consequence of this high-density storage method is that rounds stored in these tightly packed rows and columns are difficult to extract manually due to their proximity to neighboring rounds. Some ammo trays attempt to make it easier to extract rounds by instead having them loosely packed in a wide grid arrangement, each round having sufficient space around it for the user to fit their fingers. This loosely packed method makes round extraction easier at the expense of reducing storage density as a result of increasing the storage area needed for each round. The current methods of storing ammunition lack the ability to allow for high density storage and easy retrieval of rounds, while still neatly organizing them.

Therefore, there is a need to provide an ammunition organization system that provides solutions to the issues and shortcomings of the prior art detailed above.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, an ammunition storage device is provided, the ammunition storage device comprising: a plurality of ammunition organization rows, each having: a body housing having two opposing faces, each opposing face having a front portion and a back portion; a plurality of cylindrical ammunition slots formed within the body housing, wherein each cylindrical ammunition slot is configured to hold a round securely, while leaving a top portion of the round exposed; two pairs of row ports, each pair of row ports positioned on a different opposing face, and each row port of each pair of row ports being positioned on a different portion of the corresponding opposing face, such that row ports on the same portions of different opposing faces align coaxially; four magnetic row couples, each magnetic row couple inserted within a different row port, wherein the magnetic row couples are configured to allow for interconnection of the ammunition organization rows to form an ammo stack, the ammo stack having two sets of row ports, each row port of each set of row ports being configured to align coaxially with the other row ports in the set, and two terminal ends, each terminal end having two outward facing magnetic row couples, each outward facing magnetic row couple housed in and outward facing row ports; and a cover comprising: a top surface having two side edges; two port mounts, each attached to a different side edge of the top surface; two pairs of cover ports attached to the port mounts, each pair of cover ports being configured to align coaxially with different outward facing row ports and each cover port of each pair of cover ports being positioned on a different port mount near a corresponding terminal end of the ammo stack and four magnetic cover couples, each magnetic cover couple inserted within a different cover port, wherein each of the magnetic cover couples is configured to attach to a corresponding outward facing magnetic row couple on the ammo stack to attach the cover to the ammo stack, further securing the ammunition organization rows together and further preventing the rounds from falling out of their respective ammunition slots. One advantage is that ammunition may be neatly stored within the hereinabove described system to allow for greater organization. Another advantage is that ammunition organization rows may be removed from the formed ammo stack, allowing for ammo to be extracted directly from a singular ammunition organization row, resulting in a more rapid and less cumbersome acquisition of ammunition from storage. Another advantage is that the known number of ammunition slots in each ammunition organization row allows the user to quickly and easily determine the amount of ammunition stored. Another advantage is that the provided cover may both help contain and protect the enclosed rounds, while keeping the ammunition organization rows together during storage and transit.

In another aspect, an ammunition storage device is provided, the ammunition storage device comprising: a plurality of ammunition organization rows, each having: a body housing having two opposing faces; a plurality of cylindrical ammunition slots formed within the body housing, wherein each cylindrical ammunition slot is configured to hold a round securely, while leaving a top portion of the round exposed; a plurality of row ports in each opposing face and a plurality of row couples, each one connected to a row port, wherein the row couples are configured to allow for interconnection of the ammunition organization rows to form an ammo stack, the ammo stack having a plurality of sets of row ports, each row port of each set of row ports being coaxially aligned with the other row ports in said set, and two terminal ends, each terminal end having a plurality of outward facing row couples, each outward facing row couple housed in an outward facing row port and whereby the ammunition organization rows are configured to be quickly and easily coupled and decoupled selectively to and from each other. Again, an advantage is that ammunition may be neatly stored within the hereinabove described system to allow for greater organization. Another advantage is that ammunition organization rows may be removed from the formed ammo stack, allowing for ammo to be extracted directly from a singular ammunition organization row, resulting in a more rapid and less cumbersome acquisition of ammunition from storage. Another advantage is that the known number of ammunition slots in each ammunition organization row allows the user to quickly and easily determine the amount of ammunition stored.

In another aspect, an ammunition storage device is provided, the ammunition storage device comprising: a plurality of ammunition organization rows, each having: a body housing; a plurality of cylindrical ammunition slots formed within the body housing, wherein each cylindrical ammunition slot is configured to hold a round securely, while leaving a top portion of the round exposed; and a cover comprising: a cover body and a pair of cover securing fasteners, each cover securing fastener being attached to an opposite end of the cover body, wherein each of the cover securing fasteners is configured to connect the cover to the corresponding opposite ends of the plurality of ammunition organization rows, such that to hold the plurality of ammunition organization rows together and further prevent the rounds from falling out of their respective ammunition slots. Again, an advantage is that ammunition may be neatly stored within the hereinabove described system to allow for greater organization. Another advantage is that ammunition organization rows may be manipulated individually, resulting in a more rapid and less cumbersome acquisition of ammunition from storage. Another advantage is that the known number of ammunition slots in each ammunition organization row allows the user to quickly and easily determine the amount of ammunition stored. Another advantage is that the provided cover may both help contain and protect the enclosed rounds, while keeping the ammunition organization rows together during storage and transit.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
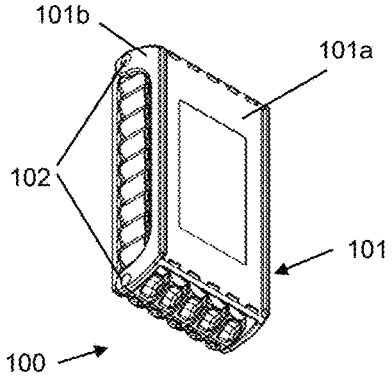
FIG. 1A-1D illustrate the top perspective, top, side and side perspective views of a fully assembled and stocked modular ammunition organization system, respectively, according to an aspect.
Figure 1B:
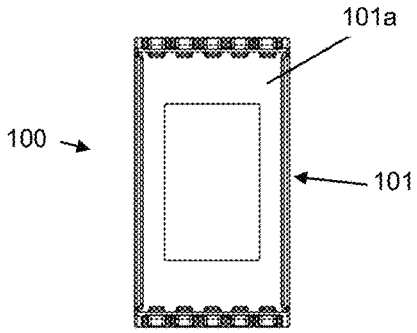
Figure 1C:
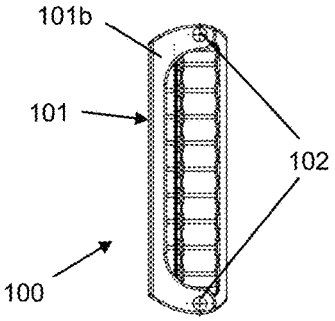
Figure 1D:
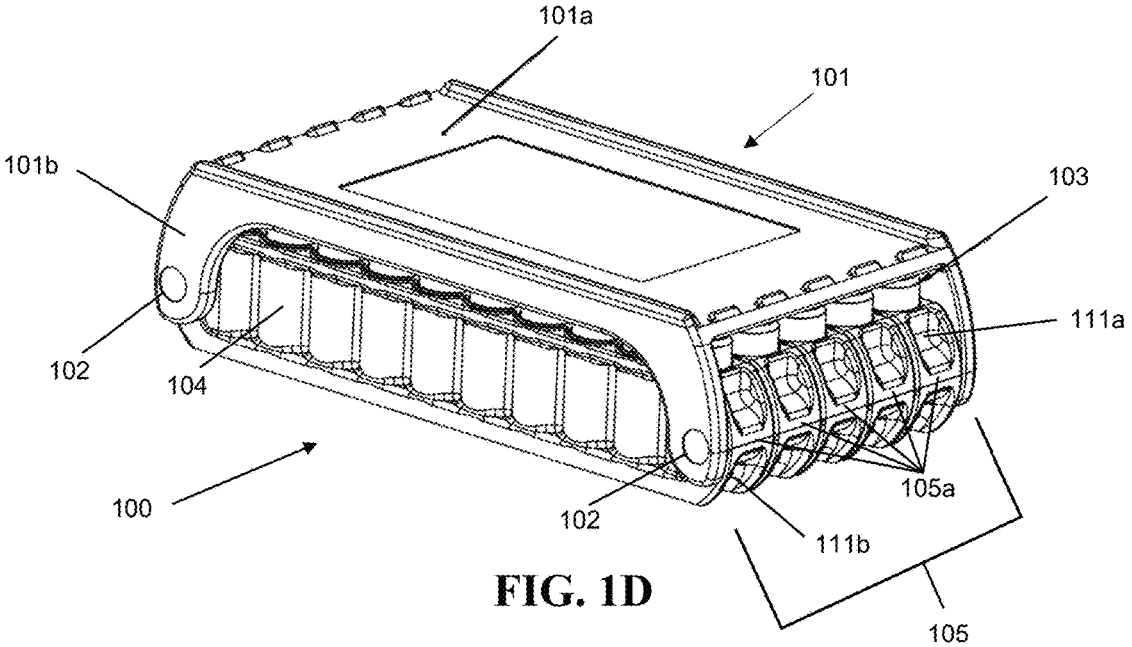

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1A-1D illustrate the top perspective, top, side and side perspective views of a fully assembled and stocked modular ammunition organization system 100, respectively, according to an aspect. This modular ammunition organization system 100 may be comprised of a plurality of ammunition organization rows 105*a* magnetically coupled to each other by incorporated magnetic row couples (not shown) housed within row ports (not shown) to form an ammo stack 105, which may then be covered by a magnetically attached cover 101. Each ammunition organization row 105*a* may have a body housing having two opposing faces, each opposing face having a front portion and a back portion, and two curved end faces, each end face having a top notch 111*a* and a bottom notch 111*b*. Each ammunition organization row 105*a* may house a plurality of rounds 103, each round of the plurality of rounds stored in a different ammunition slot 104 formed within the body housing. Each ammunition slot 104 may be composed of a cylindrical housing adapted to conform to the shape of and securely fit a singular round 103 of choice, while leaving a portion of the round 103 exposed to allow for easy manual extraction. Each opposing face may have a set of magnetic row couples (not shown) comprised of two magnetic couples, each magnetic couple housed in a row port on a different portion of the opposing face. The formed ammo stack 105 may have outward facing, unpaired, magnetic row couples, each in an outward facing row port, as a result of the outer ammo organization rows 105*a* being coupled to only a singular other row 105*a*. The formed ammo stack 105 is configured to attach to a cover 101, the cover 101 having a top surface 101*a* having two side edges and two port mounts 101*b*, each port mount 101*b* being attached to a side edge of the top surface and housing two cover ports, and four magnetic cover couples 102, each one attached to a different cover port. The ammunition organization rows 105*a* are arranged such that each magnetic row couple on each ammunition organization row 105*a* aligns coaxially with corresponding magnetic row couples on the other rows within the ammo stack, allowing the magnetic row couples to secure all of the rows together. The cover is configured to have its magnetic cover couples align coaxially with the outward facing magnetic row couples, such as outward facing magnetic row couples 206 of FIG. 2, on the ammo stack. The magnetic cover couples 102 may attach to the outward facing, unpaired magnetic row couples to secure the cover 101 to the ammo stack 105. The cover 101 when attached to the ammo stack 105 as described hereinabove helps hold each of ammunition organization rows 105*a* together, secure the rounds 103 within their respective ammunition slots 104, preventing the rounds 103 from falling out of the ammunition slots 104, as well as protects the exposed portions of the rounds 103.

The ammunition organization system 100 disclosed in FIG. 1A-1D is configured to hold five ammunition organization rows 105*a*, each ammunition organization row capable of holding ten rounds 103, each round 103 in a separate ammunition slot 104, for a total capacity of 50 rounds. The disclosed cover 101 may be modified to secure a different quantity of ammunition organization rows 105*a* through alteration of its size. The disclosed ammunition organization rows 105*a* may be modified to hold different quantities of ammunition through variance of the quantity of ammunition slots 104 in each row and resultant row size accordingly. The method of coupling the ammunition organization rows 105*a* to each other, and the cover 101 to the resultant ammo stack 105, may also be varied. The elements used for connecting the ammunition rows together may be referred to as row couples, and include magnetic couples, short pins, long pins, or other coupling devices known in the industry. The elements used for connecting the cover to a plurality of ammunition organization rows 105*a* or a resultant ammo stack 105 may be referred to as cover securing fasteners, and include magnetic couples, short pins, long pins, clasps or other coupling devices known in the industry. The preferred method of attachment of the ammunition organization rows 105*a* to each other, and the formed ammo stack 105 to the cover 101 is the use of magnetic row couples and magnetic cover couples 102 respectively, as these methods provide the user with a fast and easy way to extract the stored rounds 103 without requiring a notable amount of force to be applied to the system. The quantity and locations of cover couples and row couples may also be varied, as long as the locations and quantities of the couples are complementary between the cover 101 and the ammo stack 105, as well as each ammunition organization row 105*a*. Further modifications may be made to the ammunition organization system 100 and its elements while still being considered to be within the scope of the disclosed device.

Usage of this modular ammunition organization system 100 may provide the user with several advantages. Due to the plurality of ammunition organization rows 105*a* used, a large amount of ammunition may be stored. As a result of the ammunition organization rows 105*a* being separable from the ammo stack 105, extraction of singular rounds 103 may be done rapidly and easily through manipulation of the separated row. The storage of rounds 103 within each ammunition organization row 105*a* helps to keep this storage device organized by keeping each round 103 in the same orientation. This in turn will help in determining both the identity and quantity of each type of round present. Simple modifications may be made to the ammunition slots in order to allow for the storage of different types of ammunition. As such, multiple types of ammunition may be stored within the same modular ammunition organization system 100 while keeping the rounds 103 organized and being able to easily identify and quantitate each type. The implementation of a cover 101 over the ammunition slots helps to protect the stored ammunition during transit and prevent ammunition from spilling out, as well as further secure the held ammunition organization rows 105*a* together.

Figure 2A:
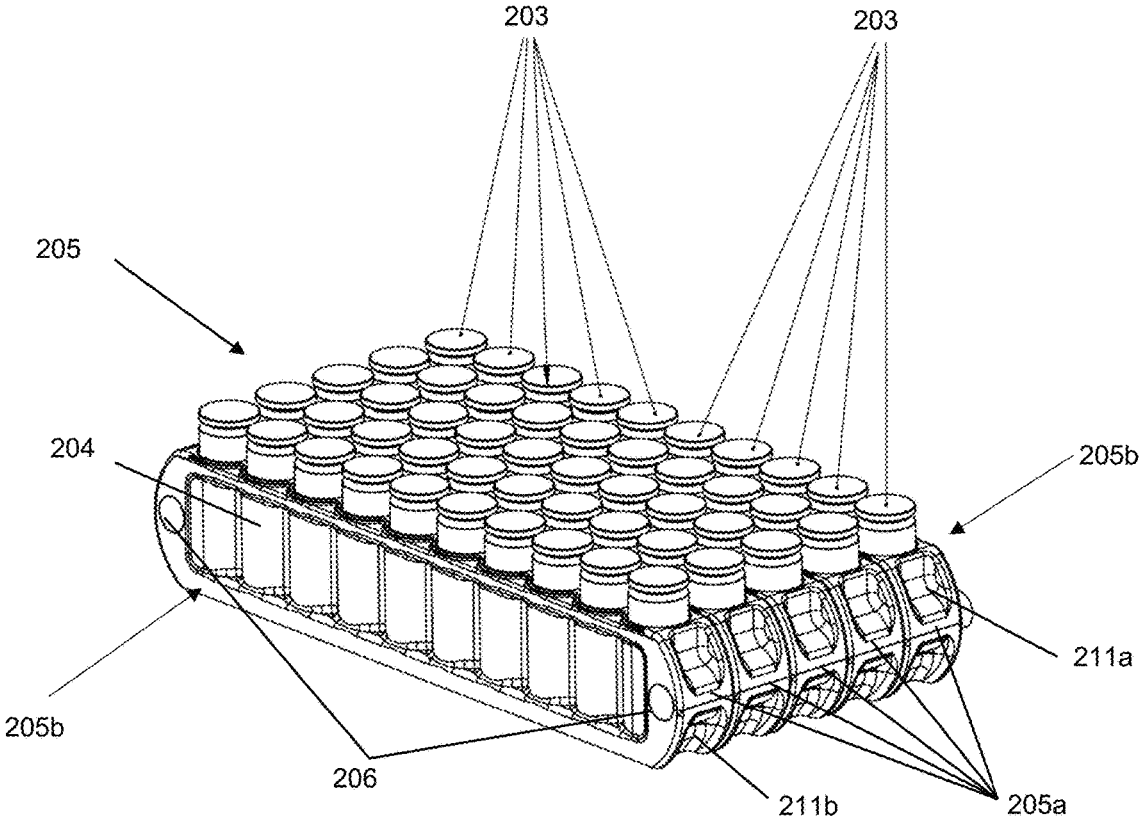
FIG. 2A-2B illustrate the side perspective and side views of five stocked ammunition organization rows interconnected, respectively, according to an aspect.
Figure 2B:
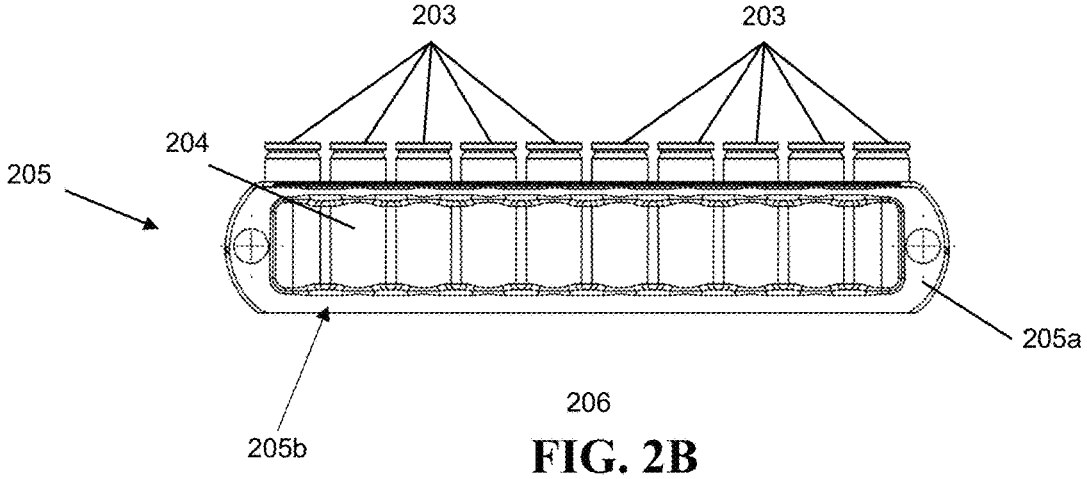

FIG. 2A-2B illustrate the side perspective and side views of five stocked ammunition organization rows 205*a* magnetically interconnected, respectively, according to an aspect. As described above, the ammunition organization rows 205*a* may be connected to each other by magnetic row couples 206 housed within row ports (not shown) to form an ammo stack 205. These magnetic row couples 206 may be located on each opposing face of each ammunition organization row 205*a*, such that each ammunition organization row 205*a* has four magnetic row couples 206 total. The magnetic row couples 206 on the opposing faces may be located near the end faces, such that the magnetic row couples 206 are positioned on distant ends of the opposing faces. These magnetic row couples 206 may also coaxially align with the magnetic cover couples (not shown), allowing unpaired magnetic row couples 206 positioned on the outward facing opposing faces ("terminal ends") 205*b*, 305*b* of a formed ammo stack 205 305 to be connected to the magnetic cover couples, helping to protect the stored rounds within the ammunition slots, preventing ammunition spillage and further securing the ammunition organization rows 205*a* together. The mechanism described herein allows for easy handling of the ammunition organization system as a whole, as well as easy separation and manipulation of each ammunition organization row 205*a*.

Both a bottom notch 211*b* and a top notch 211*a* may be present on each ammunition organization row 205*a* in order to reduce the manufacturing cost by reducing the amount of material needed. These notches may be implemented on each ammunition organization row 205*a* in a variety of shapes and sizes, as long as these variations do not negatively impact device functionality. Aside from these notches reducing the production cost of each row, a benefit of these notches is that they may provide a gripping point for the handling of each row about its end, allowing for easy manipulation of each row, without contacting the held rounds 203 or main assembly. An additional benefit of the notches is that they may provide a secure gripping site for alternative cover securing fasteners, such as clasps.

The modular nature of the herein described ammunition organization system provides it with a variety of unique functionalities. The size of the attached cover may be modified to correspond to different quantities of ammunition organization rows 205*a* held within an ammo stack 205. For example, covers designed to hold ammo stacks 205 having five, seven or ten ammunition organization rows 205*a* may be provided, such that each ammunition organization system attains the desired balance of portability and storage size. The ammunition organization rows may also be modified themselves to hold a specific number of rounds. In order to properly house a specific number of rounds, the amount of ammunition slots, along with the dimensions of the ammunition organization row and corresponding cover may need to be modified accordingly. For example, ammunition organization rows designed with five, ten or fifteen ammunition slots 204 may be provided. Additionally, ammunition organization rows 205*a* capable of holding different types of ammunition within their respective ammunition slots 204 may be enclosed within the same ammo stack 205, and thus the same ammunition organization system. This will allow users to store and transport multiple types of ammunition within the same ammunition organization system, while keeping the various types of ammunition organized and ready for use.

Figure 3A:
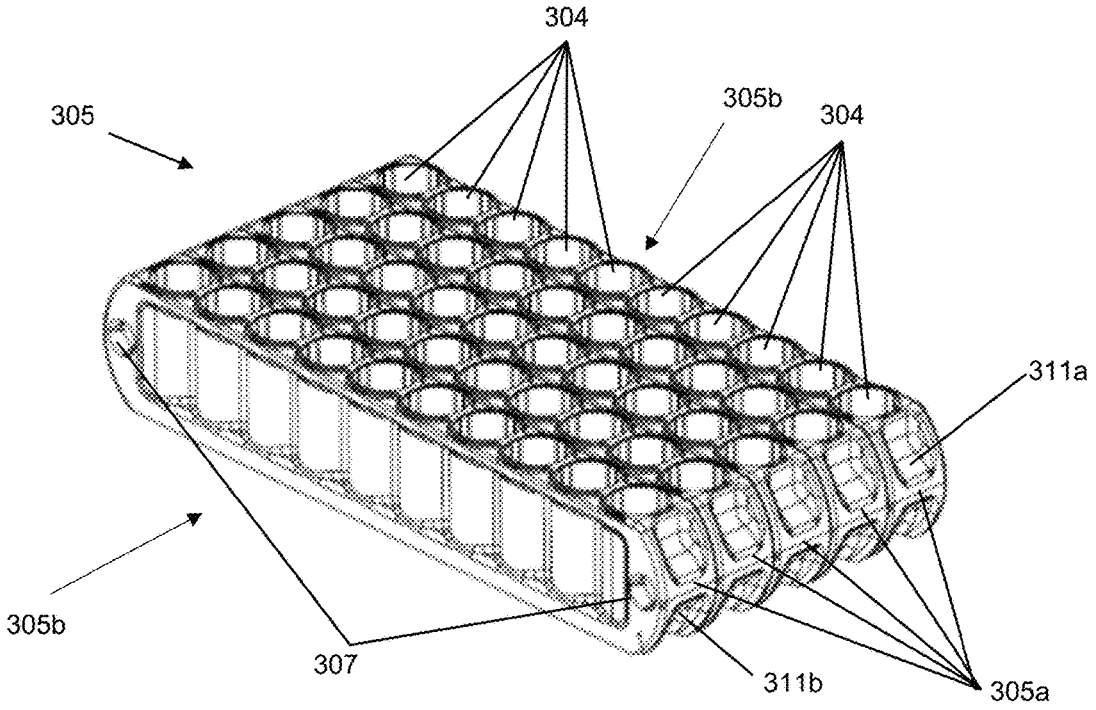
FIG. 3A-3B illustrate the side perspective and top views of five empty ammunition organization rows, respectively, according to an aspect.
Figure 3B:
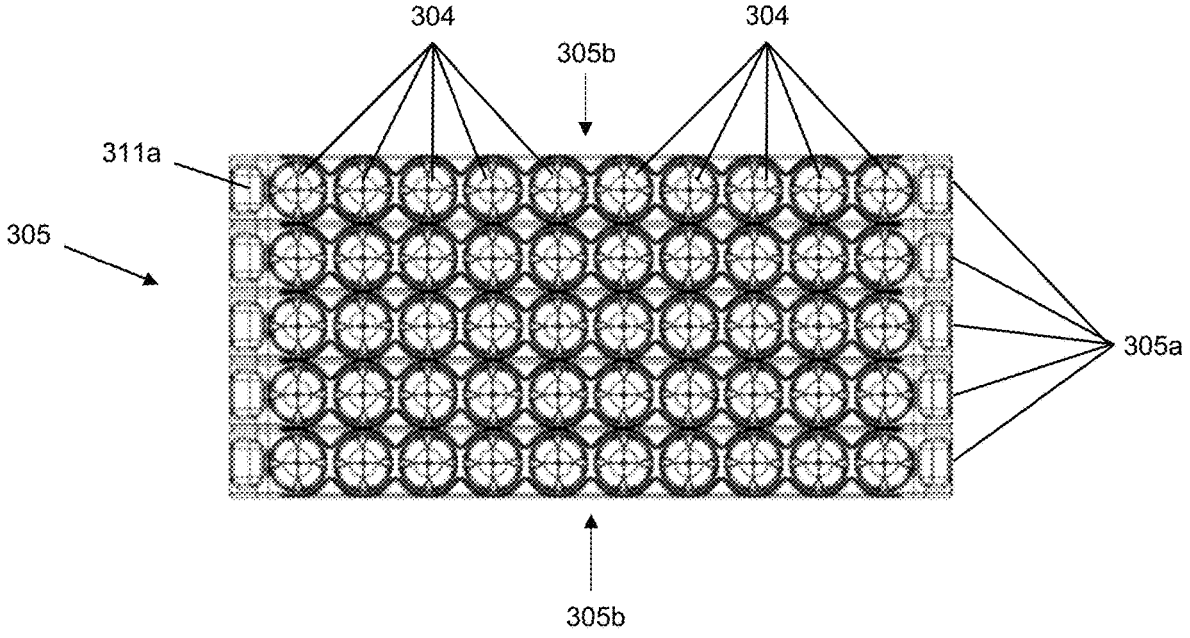

FIG. 3A-3B illustrate the side perspective and top views of five empty ammunition organization rows 305*a*, respectively, according to an aspect. The connection of each of the ammunition organization rows 305*a* to the formed ammo stack 305 by implemented couples within row ports 307, 407 may allow for easy attachment and removal of each row to and from the ammo stack 305 as needed. The unique, modular design of the ammunition organization system allows for easy manipulation of singular rounds from singular ammunition organization rows 305*a* while still allowing for large sums of ammunition to be carried within a singular storage unit. Due to the known number of ammunition slots 304 present within each of the ammunition organization rows 305*a*, a user may quickly and easily determine the number of rounds in whole system, as well as each row. Different coupling methods may be incorporated using the provided row ports 307, 407. In addition to the preferred method of using magnetic couples, one may alternatively choose to implement short fastening pins, long pins or other coupling methods known in the industry.

The ammunition slots 304 may be adapted to hold different types of ammunition as needed through simple modifications of the slot characteristics. Changes to diameter, depth and shape, amongst other variables, may allow the ammunition slots 304 to be capable of holding most types of ammunition securely. An important feature to note regarding the ammunition slots 304 is that their dimensions must be adapted to fit each housed round securely, while still allowing for easy extraction of the stored rounds without undue force. This snug fit of each round within its respective ammunition slot 304 is implemented in order to secure the rounds to their attached ammunition organization row 305*a*, to prevent ammunition spillage in the event of moderate row agitation, but still allow the rounds to be removed through inversion of the ammunition organization row 305*a* when needed. The ammunition slots 304 must also be a certain depth such that a portion of each round is exposed, in order to provide a gripping area needed for the manual extraction of each round. While the cover is detached, the identity and quantity of each stored round may be easily determined through inspection of the exposed portion of each round, allowing for organized storage of multiple types of ammunition within the same modular ammunition organization system.

While ammo stacks 305 may be used with a cover as described previously, they may also be provided as depicted in FIG. 3A-3B with no cover provided. Such ammo stacks 305 may be used in conjunction with preexisting ammunition storage mechanisms, such as ammo cans or ammo boxes. For example, an ammunition manufacturer may provide an ammo stack 305, composed of a plurality of interconnected ammunition organization rows, within a box or carton for sale. The ability of the ammunition organization rows 305*a* to be quickly and easily coupled together to form an ammo stack 305 and be individually decoupled from the formed ammo stack 305 is a key facet of the disclosed ammunition organization system and is retained even in the absence of a cover.

Figure 4A:
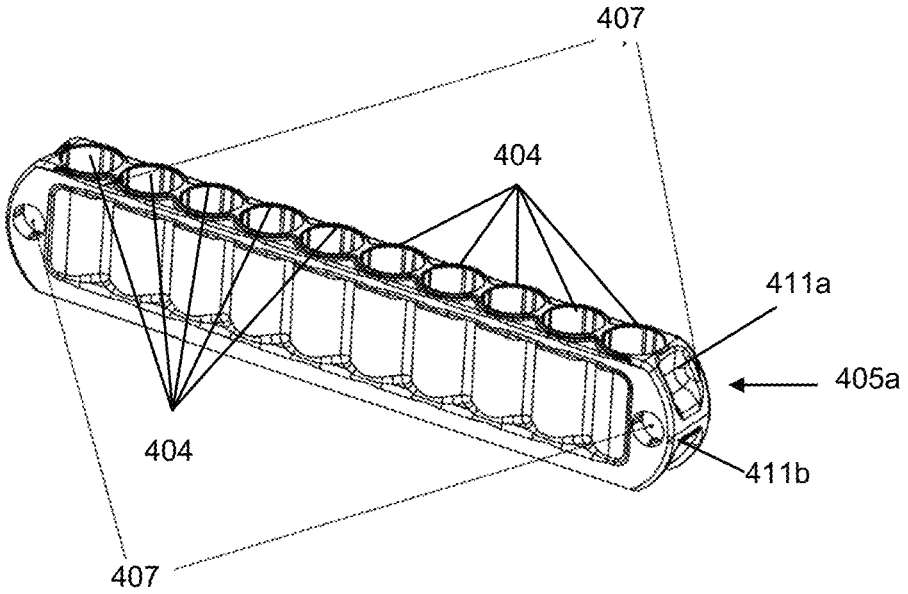
FIG. 4A-4C illustrate the side perspective, top and side views of an empty ammunition organization row, respectively, according to an aspect.
Figure 4B:
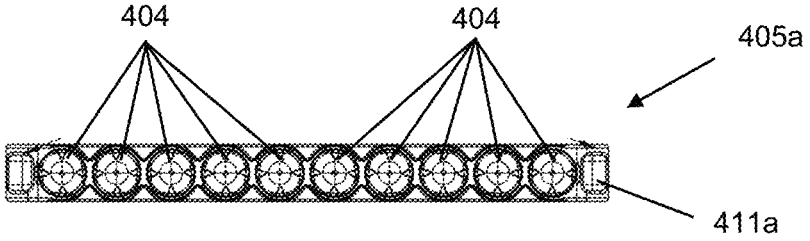
Figure 4C:
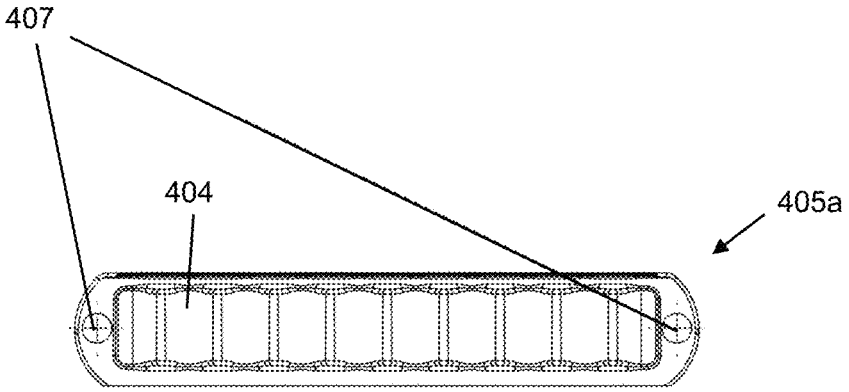

FIG. 4A-4C illustrate the side perspective, top and side views of an empty ammunition organization row 405*a*, respectively, according to an aspect. An essential aspect of the herein disclosed ammunition organization system is the ability to separate each ammunition organization row 405*a* from the ammo stack. Separation of an ammunition organization row 405*a* from the ammo stack allows the user to obtain and manipulate smaller quantities of ammunition as needed. This may help to make the acquisition of ammunition from storage more streamlined for the user by allowing each individual round to be extracted more easily, without the potential of rounds from other rows blocking or inhibiting round extraction. Additionally, by having ammunition organization rows 405*a* with a known number of ammunition slots, the user may also be able to quickly and easily determine the quantity of rounds present within an ammunition organization row 405*a*. The ammunition organization rows 405*a* and cover may be manufactured from a suitable material, such as metal or plastic, and be constructed through an appropriate method, such as die-casting, injection molding or three-dimensional printing.

A method for stocking the disclosed ammunition organization system from a supplied ammo tray may be broken down into several steps. First, invert a stocked ammo tray onto a flat plate that is resting upon a level surface, such that all the rounds are placed together in rows and oriented with the bullet portion of the round facing up. Second, obtain a singular empty ammunition organization row, such as empty ammunition organization row 405*a* depicted in FIG. 4A-4C, orient the empty row 405*a* with its plurality of ammunition slots 404 facing downward and place the empty row 405*a* over a plurality of rounds, such that each ammunition slot 404 is now filled by a round. Upon completion of this second step, the empty row 405*a* will become a loaded ammunition organization row, much like a loaded ammunition organization row 205*a* depicted in FIG. 2A-2B. Repeat this second step, obtaining, orienting and placing empty ammunition organization rows 405*a* over pluralities of rounds, creating a plurality of singular loaded ammunition organization rows 205*a*, until all of the rounds have been covered. Third, use the provided row couples on each row, such as the magnetic row couples 206 depicted in FIG. 2A-2B, to couple all of the singular loaded ammunition organization rows 205*a* together into a loaded ammo stack, such as the loaded ammo stack 205 depicted in FIG. 2A-2B. Fourth, hold the loaded ammo stack 205 to the flat plate firmly and invert both of them, such that the plate is now resting on top of the rounds 203 held within the loaded ammo stack 205. Finally, remove the plate, and attach a cover, such as cover 101 depicted in FIG. 1A-1D, to the loaded ammo stack 205, by attachment of the provided cover couples, such as magnetic cover couples 102, to the provided row couples 206 on the ammo stack. Upon completion, a fully stocked ammunition organization system will be formed, such as fully stocked ammunition organization system 100 depicted in FIG. 1A-1D. Similar methods of obtaining and loading each ammunition organization row, coupling each ammunition organization row together into an ammo stack and then covering the ammo stack may be utilized to create a fully stocked ammunition organization system 100 that is ready for use.

Once a fully stocked ammunition organization system 100 is obtained, the stored ammunition may be used in order to rapidly load a magazine for use with a firearm. First, remove the cover 101 from the ammunition organization system 100, in order to reveal a fully loaded ammo stack 205. When using magnetic cover couples 102, cover removal may be done by simply pulling the attached cover upward to remove it from the ammo stack. Second, decouple a singular loaded ammunition organization row 205*a* from the ammo stack 205. When using magnetic row couples 206, decoupling may be done easily by simply pulling a single loaded ammunition organization row 205*a* away from the ammo stack 205. Third, transfer each held round 203 manually or by using a speedloader (not shown) to a firearm magazine. Repeat the second decoupling step and third transfer step until all off the loaded ammunition organization rows 205*a* have had all their rounds 203 removed, resulting in a plurality of decoupled, empty ammunition organization rows 405*a* and a plurality of loaded magazines being formed. This process may also be used for loading a singular magazine multiple times as needed through minor step modification. This process of loading a magazine may be greatly eased and hastened through the use of the disclosed ammunition organization system 100.

Figure 5A:
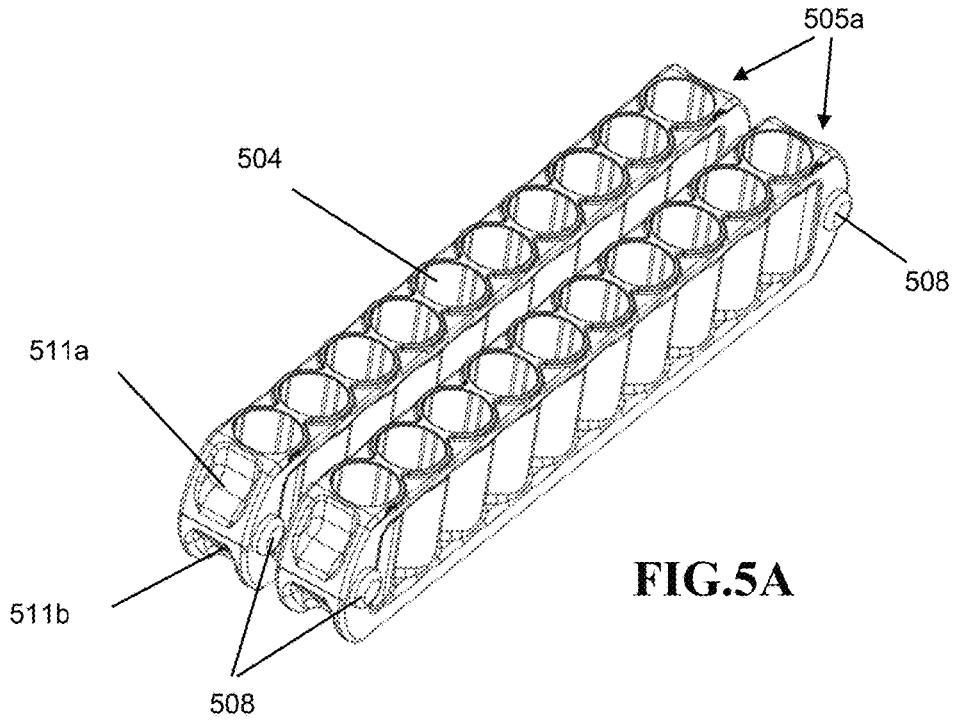
FIG. 5A-5C illustrate the top perspective, top and front views of two empty ammunition organization rows, each fitted with short fastening pins, according to an aspect.
Figure 5B:
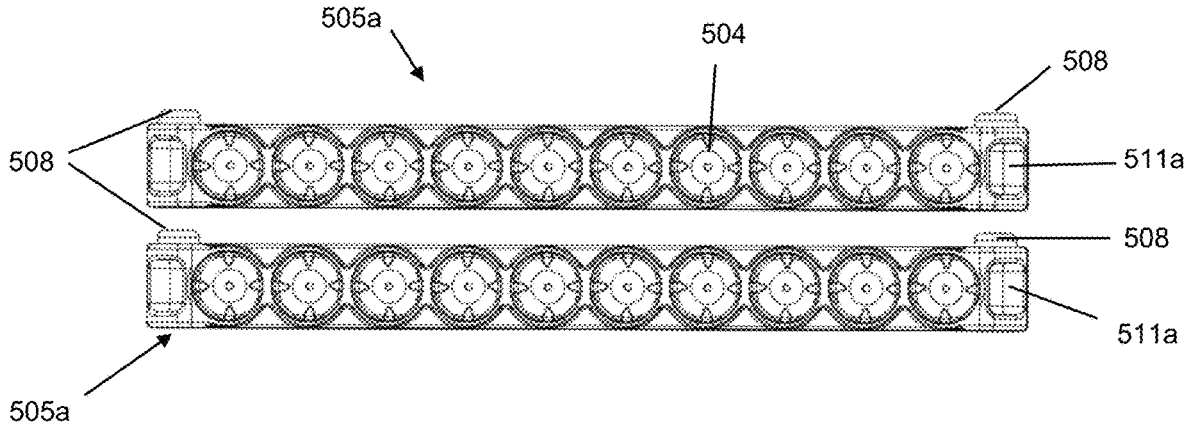
Figure 5C:
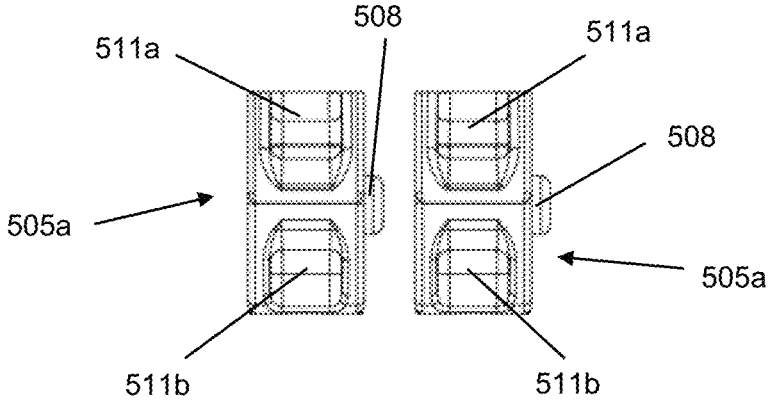
Figure 5D:
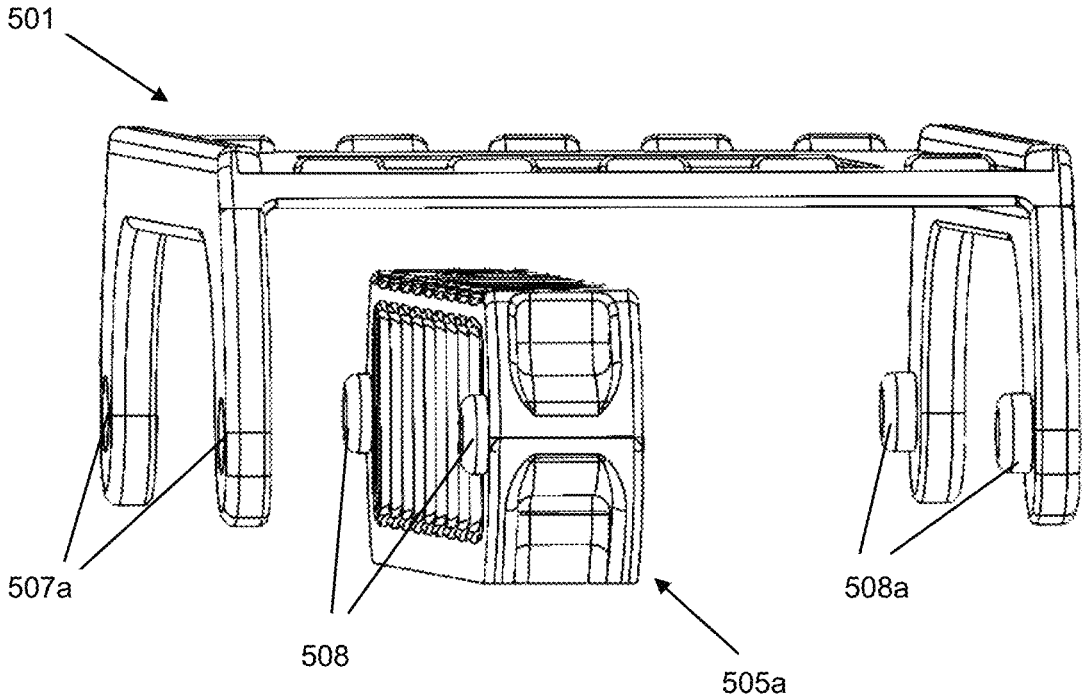
FIG. 5D illustrates the front perspective view of a singular empty ammunition organization row fitted with short fastening pins beneath a cover fitted with short cover pins, according to an aspect.

FIG. 5A-5C illustrate the top perspective, top and front views of two empty ammunition organization rows 505*a*, each fitted with short fastening pins 508, according to an aspect. FIG. 5D illustrates the front perspective view of a singular empty ammunition organization row 505*a* fitted with short fastening pins 508 beneath a cover 501 fitted with short cover pins 508*a*, according to an aspect. While the preferred row couples and cover securing fasteners are both magnetic couples, alternative methods may also be implemented as needed. Two short fastening pins 508 may be placed in row ports (not shown) on one opposing face of each ammunition organization row 505*a* for insertion into complementary empty row ports (not shown) on the opposite opposing face of another ammunition organization row 505*a*. The cover 501 may attach to a formed ammo stack in a similar manner by having empty cover ports 507*a* adapted to fit the short fastening pins 508 on one side the ammo stack and short cover pins 508*a* adapted to fit within the empty row ports on the other side of the ammo stack. A secure fitting of the short cover pins 508*a* on the cover and short fastening pins 508 on the rows to their corresponding empty ports is preferred, as this will allow for a secure but removable attachment of the cover to the ammo stack, as well as secure interconnection of the ammunition organization rows 505*a* in the ammo stack upon removal of the cover, while allowing for each ammunition organization rows 505*a* to be decoupled from the ammo stack without requiring excessive force. The quantity of row ports, cover ports 507*a*, short fastening pin 508 and short cover pin 508*a* couples may be varied accordingly as needed. As with the magnetic row couples, the short fastening pins 508 may be used to interconnect ammunition organization rows 505*a* into an ammo stack, even in the absence of a cover. This fastening method may allow for similar results to using magnetic couples and may be useful in applications that don't allow the use of magnets or otherwise require an alternate fastening method.

Figure 6A:
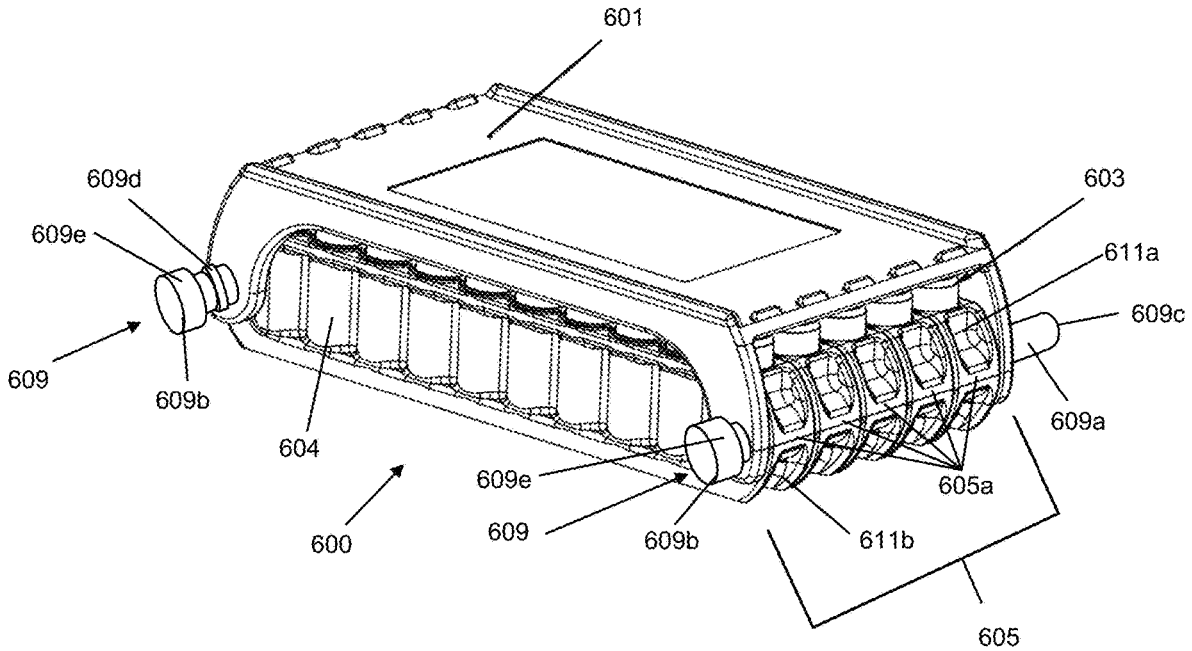
FIG. 6A-6B illustrate the side perspective and top views of an ammunition organization system with long pins, respectively, according to an aspect.
Figure 6B:
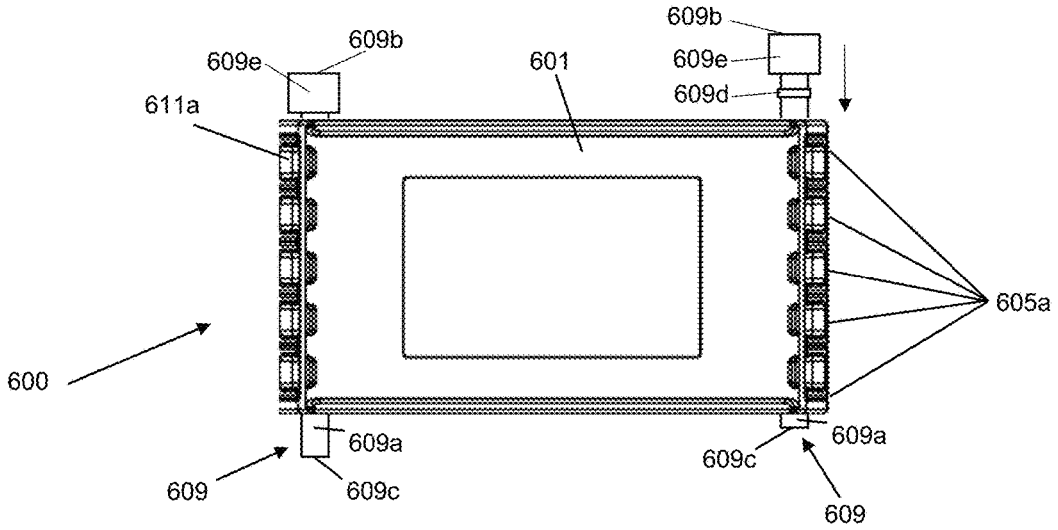
Figure 6C:
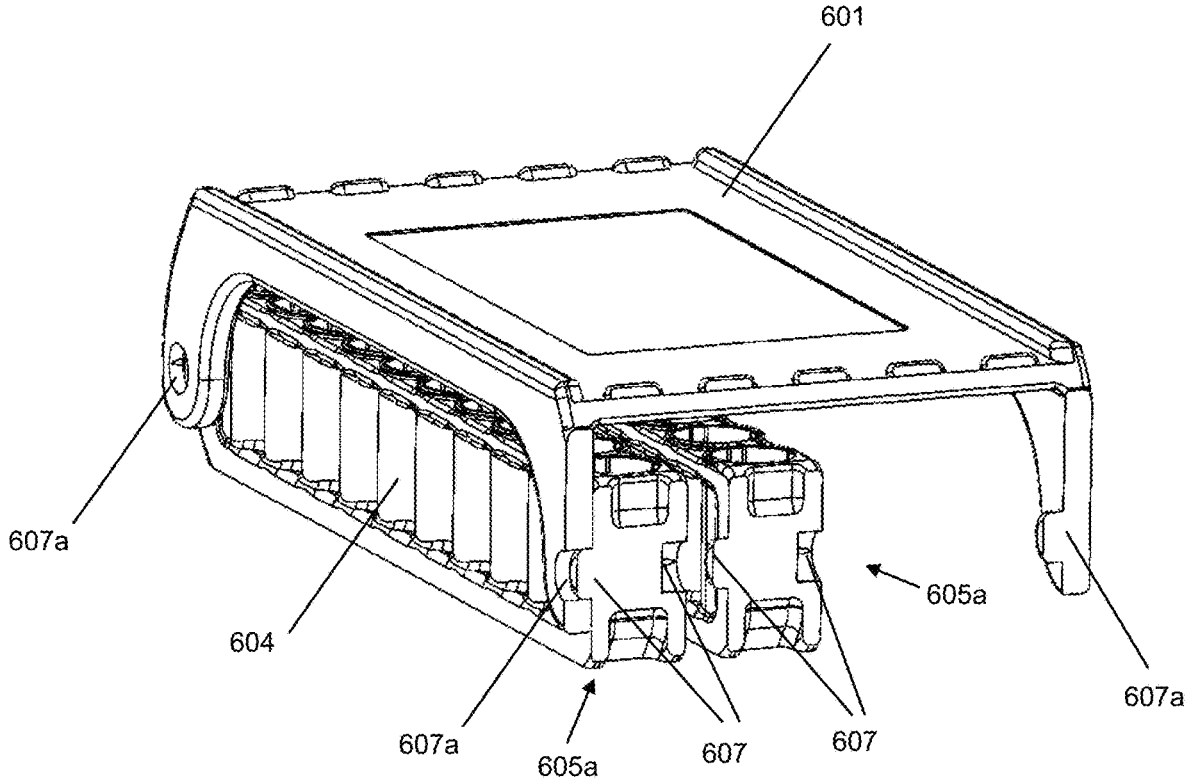
FIG. 6C illustrates the front perspective view of two ammunition organization rows beneath a cover, the cover having cover ports that coaxially align with sets of row ports on said ammunition organization rows, according to an aspect.

FIG. 6A-6B illustrate the side perspective and top views of an ammunition organization system 600 with long pins 609, respectively, according to an aspect. FIG. 6C illustrates the front perspective view of two ammunition organization rows 605*a* beneath a cover 601, the cover 601 having cover ports 607*a* that coaxially align with sets of row ports 607 on said ammunition organization rows 605*a*, according to an aspect. Another alternate method of connecting ammunition organization rows 605*a* to each other as well as to the cover 601, is the utilization of long pins 609 as both row couples and cover securing fasteners. A long pin 609 may travel through a series of coaxially aligning row ports 607 located within each ammunition organization row 605*a* as well as corresponding cover ports 607*a*, as seen in FIG. 6A-6B. The long pin 609 may be comprised of a rod 609*a* with a securing end 609*b* and a traveling end 609*c*, the rod having a diameter that fits securely within the row and cover ports, a locking ridge 609*d* of a slightly greater diameter than the rod 609*a* and located near the securing end 609*b* of the long pin 609 and a large diameter cap 609*e* at the securing end 609*b* of the rod that is too large to travel through the ports. The traveling end 609*c* of the long pin 609 may be inserted through a series of coaxially aligning row ports 607 and cover ports 607*a*. The rod 609*a* is of such a length that it may travel through all coaxially aligning row and cover ports. The locking ridge 609*d* may be pushed through one of the cover ports with a small amount of force. Upon passage of the locking ridge 609*d* though a cover port to confine said cover port between the locking ridge 609*d* and the cap 609*e*, the long pin 609 will secure the cover to the enclosed ammunition organization rows 605*a*. Two long pins 609 may be inserted through different sets of coaxially aligning row ports 607 and cover ports 607*a* to fully secure the cover 601 to the ammunition organization rows 605*a*, preventing rotation of the rows or cover. The long pins 609 may also attach to the cover 601 and ammo organization rows 605*a* through similar methods, such as including the locking ridge 609*d* as part of the cap 609*e* or putting the locking ridge 609*d* on the traveling end 609*c* of the long pin 609. Upon removal of the long pins 609, the cover 601 and each ammunition organization row 605*a* may then be moved freely. Applications that may require a very firm method of coupling the ammo stack to the cover may consider use of this coupling method.

Figure 7A:
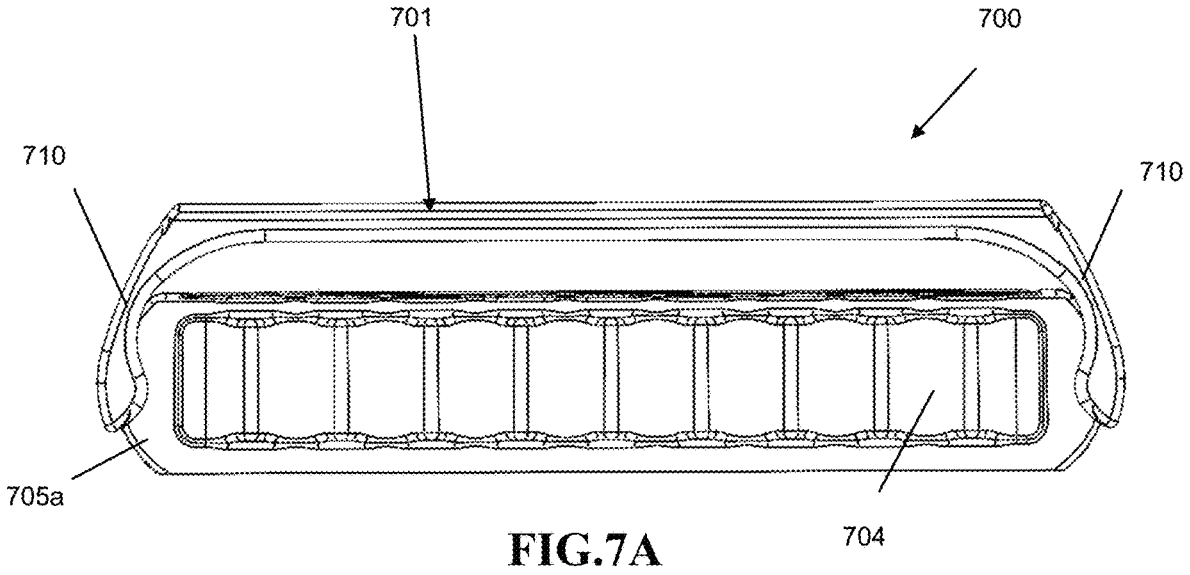
FIG. 7A-7B illustrate the side and side perspective views of an empty ammo organization system having a cover with clasps, respectively, according to an aspect.
Figure 7B:
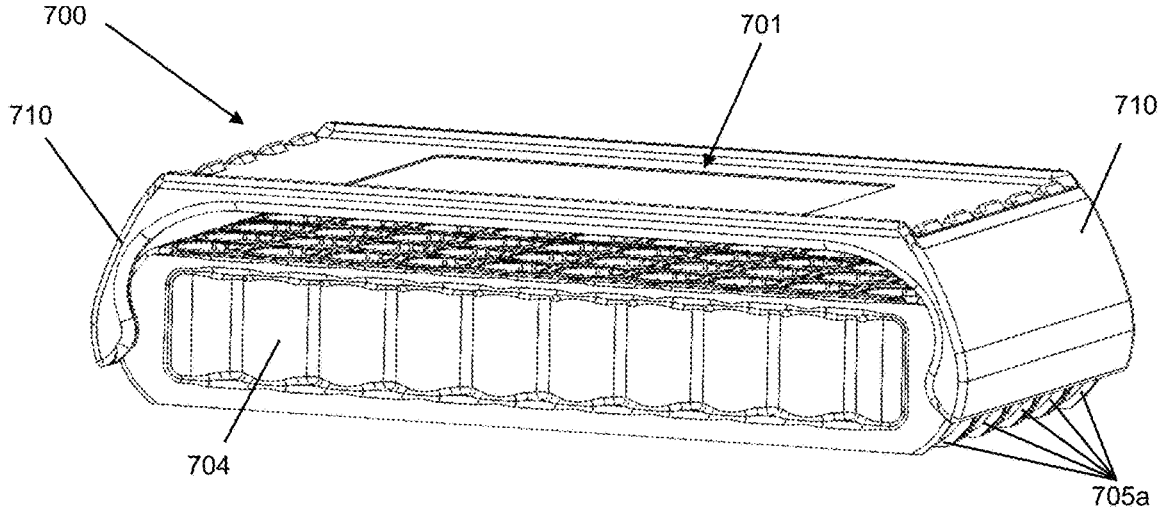

FIG. 7A-7B illustrate the side and side perspective views of an empty ammo organization system 700 having a cover 701 with clasps 710, respectively, according to an aspect. Usage of a cover 701 having clasps 710 as cover securing fasteners would allow for a plurality of ammunition organization rows 705*a* to be attached to a cover 701, but without a need for an internal means of coupling each ammunition organization row 705*a* to each other. The cover 701 may include a pair of clasps 710, each clasp attached to an opposite end of the cover. Each clasp of the pair of clasps may follow the contours of and snaps over an opposite end of the ammunition organization rows 705*a*. The clasps 710 may be of such a length that they are capable of fastening the enclosed ammo organization rows 705*a* together by extending beyond and securing lower portions of opposite ends of each ammo organization row 705*a*, as depicted in FIG. 7A-7B. A second set of clasps 710 used as cover securing fasteners may also be implemented, for a total of four clasps 710 attached to the cover 701. Each clasp 710 of this second set of clasps may be attached to one end of a second set of opposite ends on the cover 701 and connect to a corresponding end of a second set of opposite ends on the grouping of ammunition organization rows 705*a*. This four clasp 710 configuration may be useful in applications where the cover 701 must attach firmly to ammunition organization rows 705*a*, but still must be easy to remove by hand. The cover 701 and the attached clasps 710 may be made of a slightly flexible material, such as plastic or metal, such that they may be manually flexed to attach to or be removed from a grouping of ammunition organization rows 705*a* but will stay connected to them during transit and storage. Much like all alternate methods of ammunition organization system 700 coupling, this method may be utilized in instances where other methods are not viable.

Small teeth or ridges (not shown) may be present on the clasps 710 to help secure the encased ammunition organization rows 705*a* to the cover 701 by connecting to the notches (not shown) on each ammunition organization row 705*a* or other ammunition organization row 705*a* element. The cover 701 with clasps 710 may also secure the ammunition organization rows 705*a* together with the cover 701 without the use of teeth, ridges or similar gripping methods, simply by smoothly fitting around the contours of each ammunition organization row 705*a* at opposite ends of the plurality of ammunition organization rows 705*a* to restrict their movement and prevent separation.

The cover 701 with clasps 710 may also be used in conjunction with other coupling methods. It is possible to attach the ammunition organization rows to each other using magnetic row couples, and then cover the magnetically bound ammo stack with a cover 701 with clasps 710. Similarly, the other alternate coupling methods including the short fastening pins seen in FIGS. 5A-5B and the long pins seen in FIG. 6A-6B may also be used to interconnect the ammunition organization rows, while still using the cover 701 with clasps 710 to cover the formed ammo stack. While it is not necessary to interconnect the ammunition organization rows 705*a* during transit or storage while using this cover 701 with clasps 710 described herein, it may become relevant to do so in applications in which keeping the ammo stack together after removal of the cover 701 is necessary or desired.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

The term "ammo stack" is used to refer to a plurality of ammunition organization rows connected to each other. The term "round" is used to refer to a singular unit of ammunition.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. An ammunition storage device comprising:

a plurality of ammunition organization rows, each having:

a body housing having two opposing faces, each opposing face having a front portion and a back portion;

a plurality of cylindrical ammunition slots formed within the body housing, wherein each cylindrical ammunition slot is configured to hold a round securely, while leaving a top portion of the round exposed;

two pairs of row ports, each pair of row ports positioned on a different opposing face, and each row port of each pair of row ports being positioned on a different portion of the corresponding opposing face, such that row ports on the same portions of different opposing faces align coaxially;

four magnetic row couples, each magnetic row couple inserted within a different row port, wherein the magnetic row couples are configured to allow for interconnection of the ammunition organization rows to form an ammo stack, the ammo stack having two sets of row ports, each row port of each set of row ports being configured to align coaxially with the other row ports in the set, and two terminal ends, each terminal end having two outward facing magnetic row couples, each outward facing magnetic row couple housed in an outward facing row ports; and a cover comprising:

a top surface having two side edges;

two port mounts, each attached to a different side edge of the top surface;

two pairs of cover ports attached to the port mounts, each pair of cover ports being configured to align coaxially with different outward facing row ports and each cover port of each pair of cover ports being positioned on a different port mount near a corresponding terminal end of the ammo stack and four magnetic cover couples, each magnetic cover couple inserted within a different cover port, wherein each of the magnetic cover couples is configured to attach to a corresponding outward facing magnetic row couple on the ammo stack to attach the cover to the ammo stack, further securing the ammunition organization rows together and further preventing the rounds from falling out of their respective ammunition slots.

2. The ammunition storage device of claim 1, wherein each ammunition organization row has ten ammunition slots.

3. The ammunition storage device of claim 2, wherein the ammo stack is comprised of five magnetically connected ammunition organization rows.

4. An ammunition storage device comprising:

a plurality of ammunition organization rows, each having:

a body housing having two opposing faces, each opposing face having a plurality of row ports;

a plurality of cylindrical ammunition slots formed within the body housing, wherein each cylindrical ammunition slot is configured to hold a round securely, while leaving a top portion of the round exposed; and a plurality of row couples, wherein each row port is adapted to selectively receive one of the plurality of row couples consisting of a long pin, a short pin, and a magnetic row couple, each row couple being housed within a selected row port, wherein the plurality of row couples are configured to allow for interconnection of the ammunition organization rows to form an ammo stack, the ammo stack having a plurality of sets of row ports, each row port of each set of row ports being coaxially aligned with the other row ports in said set, and two terminal ends, each terminal end having a plurality of outward facing row ports and whereby the ammunition organization rows are configured to be quickly and easily coupled and decoupled selectively to and from each other; and a cover having:

a cover body sized to conform to the ammo stack;

a plurality of cover port pairs attached to the cover body, each cover port pair being configured to align coaxially with different outward facing row ports and each cover port of each cover port pair positioned at a different terminal end of the ammo stack; and a plurality of cover securing fasteners attached to the cover body, wherein the cover securing fasteners are configured to attach the cover to the ammo stack, further securing the ammunition organization rows together and further preventing the rounds from falling out of their respective ammunition slots.

5. The ammunition storage device of claim 4, wherein the row couples are a plurality of magnetic row couples, each magnetic row couple housed within one of the plurality of row ports on each opposing face.

6. The ammunition storage device of claim 5, wherein the cover securing fasteners are a plurality of magnetic cover couples, each magnetic cover couple housed within one of the plurality of cover ports.

7. The ammunition storage device of claim 4, wherein the row couples are a plurality of short fastening pins, each short fastening pin housed within one of the plurality of row ports in one opposing face of each ammunition organization row and configured to fit securely into an empty row port on the opposite opposing face of another ammunition organization row.

8. The ammunition storage device of claim 7, wherein the cover securing fasteners are a plurality of cover ports for connection to one terminal end of the ammo stack, each cover port being configured to fit a short fastening pin from the ammo stack, and a plurality of cover pins for connection to the other terminal end of the ammo stack, each cover pin being configured to fit into a row port on the ammo stack.

9. The ammunition storage device of claim 4, wherein the row couples are a plurality long pins, each long pin being configured to run completely through a coaxially aligned set of row ports in the ammo stack.

10. The ammunition storage device of claim 9, wherein the plurality of long pins are configured to also run through the corresponding coaxially aligned cover port pairs and thus acting also as cover securing fasteners.

11. The ammunition storage device of claim 4, wherein the size of the cover body corresponds to the number of ammunition organization rows in the ammo stack.

* * * * *